US006061998A

United States Patent [19]

Gorlich

[11] Patent Number: 6,061,998

[45] **Date of Patent: *May 16, 2000**

[54] METHOD OF PACKAGING MEAT PRODUCTS

[75] Inventor: Michael P. Gorlich, Hilton Head Island, S.C.

[73] Assignee: World Class Packaging Systems, Inc., Hilton Head Island, S.C.

[ * ] Notice: This patent is subject to a terminal disclaimer.

[21] Appl. No.: 08/117,446

[22] Filed: Sep. 7, 1993

[51] Int. Cl.[7] ..... B05B 31/02

[52] U.S. Cl. ..... 53/432; 426/129; 426/418

[58] Field of Search ..... 53/133.4, 432, 53/468, 510, 139.2, 465; 426/129, 418; 206/497

[56] References Cited

U.S. PATENT DOCUMENTS

| | | | |
|---|---|---|---|
| 2,621,129 | 12/1952 | Ramsbottom et al. | 426/129 |
| 3,287,876 | 11/1966 | Willbrandt | 53/465 |
| 3,347,365 | 10/1967 | Funkhouser | 53/465 |
| 3,351,265 | 11/1967 | Miller | 426/129 |
| 3,360,382 | 12/1967 | Miller | 53/432 |
| 3,574,642 | 4/1971 | Weinke | 99/174 |
| 3,681,092 | 8/1972 | Titchenal et al. | 99/174 |
| 3,692,544 | 9/1972 | Dendrinos | 206/497 |
| 3,696,580 | 10/1972 | Saltzer, Sr. | 206/497 |
| 3,713,849 | 1/1973 | Grindrod et al. | 99/174 |
| 3,997,677 | 12/1976 | Hirsch et al. | 426/113 |
| 4,018,904 | 4/1977 | Muraoka | 206/497 |
| 4,055,672 | 10/1977 | Hirsch et al. | 426/129 |
| 4,372,096 | 2/1983 | Baum | 53/103 |
| 4,437,293 | 3/1984 | Sanborn, Jr. | 53/139.2 |
| 5,121,590 | 6/1992 | Scanlan | 53/103 |

*Primary Examiner*—Rodney A. Butler
*Attorney, Agent, or Firm*—Trop, Pruner & Hu, P.C.

[57] ABSTRACT

A method for packaging a food product for staged production and sale involves packaging the food product in a first package containing a preservative atmosphere which is low in oxygen content. In this way, the useful life of the meat product is extended. At the retail level, when sale is imminent, the package may be opened, the meat product bloomed and subsequently repackaged for retail sale.

3 Claims, 4 Drawing Sheets

METHOD OF PACKAGING MEAT PRODUCTS

FIELD OF THE INVENTION

This invention relates to methods for packaging food products which are adapted for gaseous exchange to extend the life of the food product. Particularly, the present invention relates to a process for allowing central meat processing for subsequent retail sale at remote locations.

BACKGROUND OF THE INVENTION

Historically, meat products have been butchered and packaged in each supermarket or other retail outlet. It has long been recognized that this arrangement is extremely inefficient and expensive. Instead, it would be preferable to permit the meat to be butchered and packaged at an efficient facility which benefits from economies of scale and thereafter shipped to individual supermarkets or other retail outlets. Moreover, because of problems with proper disposal of waste, butchering at a central location is preferable.

In the past, this desirable goal has not been achievable because most consumers prefer to buy meat which is red in color as a result of exposure to oxygen. However, the meat maintains its red color for only one to two days. Thereafter, it turns to a purple color which is undesirable to most consumers. Therefore, if the meat were butchered and packaged in one location and then shipped to another location for eventual sale, by the time the package reached the retail outlet the meat would have undergone the transformation to the purple color and would be effectively unsalable.

To overcome these problems, there have been a number of efforts to maintain the food product in a first atmosphere during shipping and a second atmosphere when the meat product is ready for retail sale. It is not believed that any of these techniques have yet achieved significant commercial acceptance. Therefore, it is highly desirable to provide a system that would permit remote meat preparation and subsequent sale after the passage of more than a couple of days.

One problem is that while the need for such a package is great, consumers may not be willing to invest a large amount of money in elaborate packages. Thus, it would be highly desirable to have a package that is convertible between two very different packaging conditions, yet is very economical. Moreover, it is also advantageous for the package to look similar to packages with which consumers are currently accustomed.

SUMMARY OF THE INVENTION

These and other important advantages of the present invention may be achieved by a method of packaging meat products. The method includes the step of placing the meat product on a package tray. A low oxygen content environment is established around the meat product on the tray. The meat product on the tray is then covered to maintain the preservative environment around the meat product. Subsequently, the meat product on the tray is uncovered when it is ready for retail sale. Then the meat product is exposed to an increased oxygen content environment. Finally, the meat product on the tray is re-covered for retail sale.

DESCRIPTION OF THE PREFERRED EMBODIMENT

Figure 1:
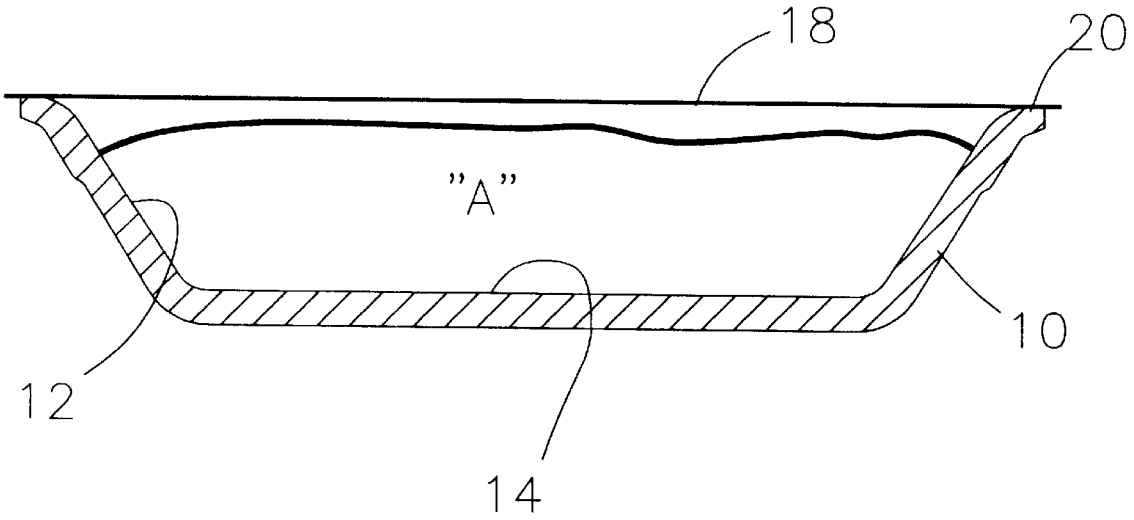
FIG. 1 is a cross-sectional view of one embodiment of the meat package in accordance with the present invention as it might leave a central processing facility.

Referring to the drawing wherein like reference characters are used for like parts throughout the several views, a meat tray 10, shown in FIG. 1, includes a pair of angled sides 12 and a bottom 14 such that a cup shaped receptacle is provided for receiving the red meat product "A". The tray 10, which acts as a fluid barrier, may take a variety of forms but conventionally is formed of molded plastic or plastic foam.

A plastic fluid impermeable film 18 is secured to the sealing flange 20 which encircles the upper surface of the tray 10. The film 18 may take a variety of forms including any conventional plastic material which is safe for use in connection with foods and which is substantially impermeable to fluids. The film 18 may be secured to the tray 10 in any conventional fashion including heat sealing or appropriate adhesive treatments.

The first stage packaging of the food product "A" is as follows. Initially, the meat product "A" is placed within the tray 10. A desired preservative environment is established around the meat product "A" and thereafter that environment is sealed inside the package by securing the impermeable film 18 to the sealing flange 20 of the tray 10.

The preservative environment contained inside the tray 10 may be one of a variety of types. However, the only important characteristic of the environment is that it contain a relatively low concentration of oxygen. For example, gases including substantial concentrations of carbon dioxide or nitrogen may be maintained within the package to reduce the exposure of the food product "A" to oxygen. In the case of red meat products, this forestalls the blooming of the meat product until a later time. Blooming is simply the transformation to the red color which is familiar to meat purchasers.

As a result of the packaging of the meat product "A" in a preservative environment, the useful life of the meat is significantly extended. This makes it possible to butcher the meat in a central location which has significant economies of scale, package it in a preservative environment, and send it on to a retail outlet for subsequent blooming.

Figure 2:
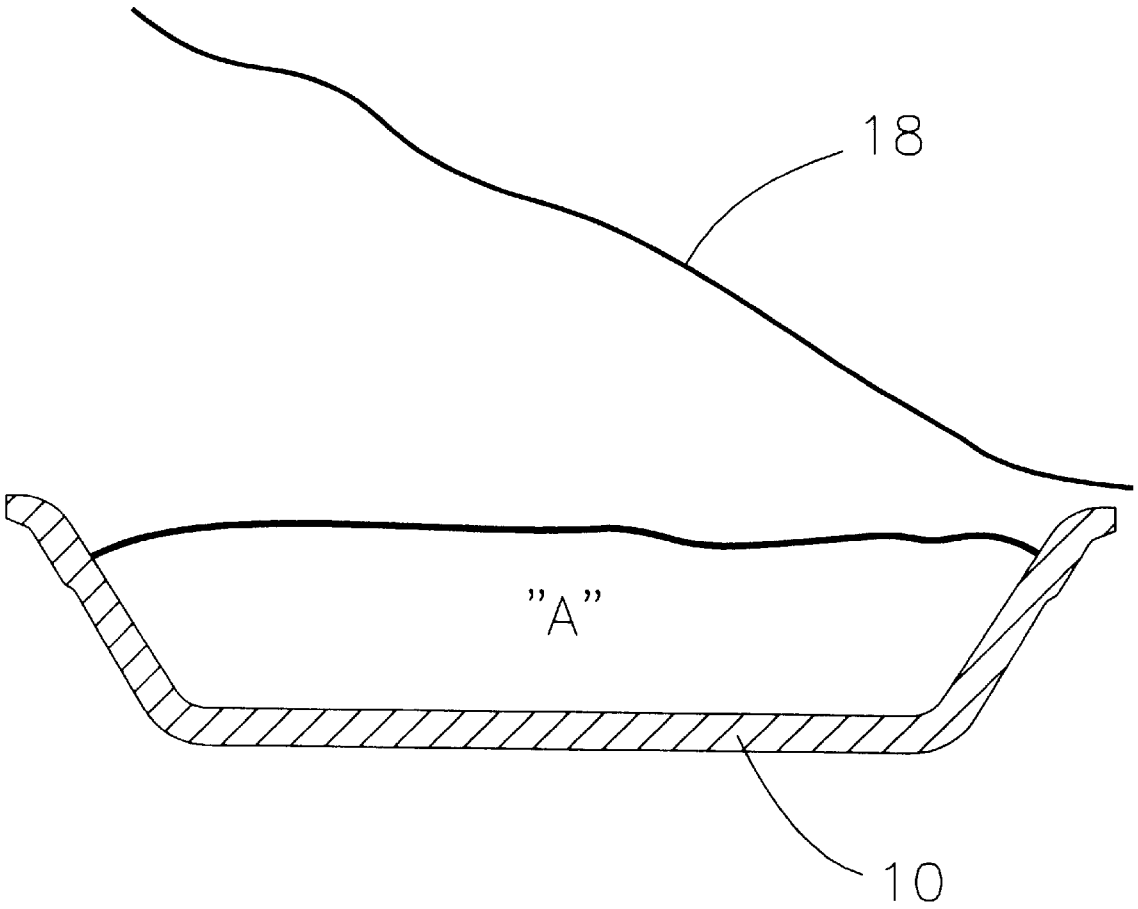
FIG. 2 is a cross-sectional view of the package being opened, for example, when it reaches a retail outlet.
Figure 3:
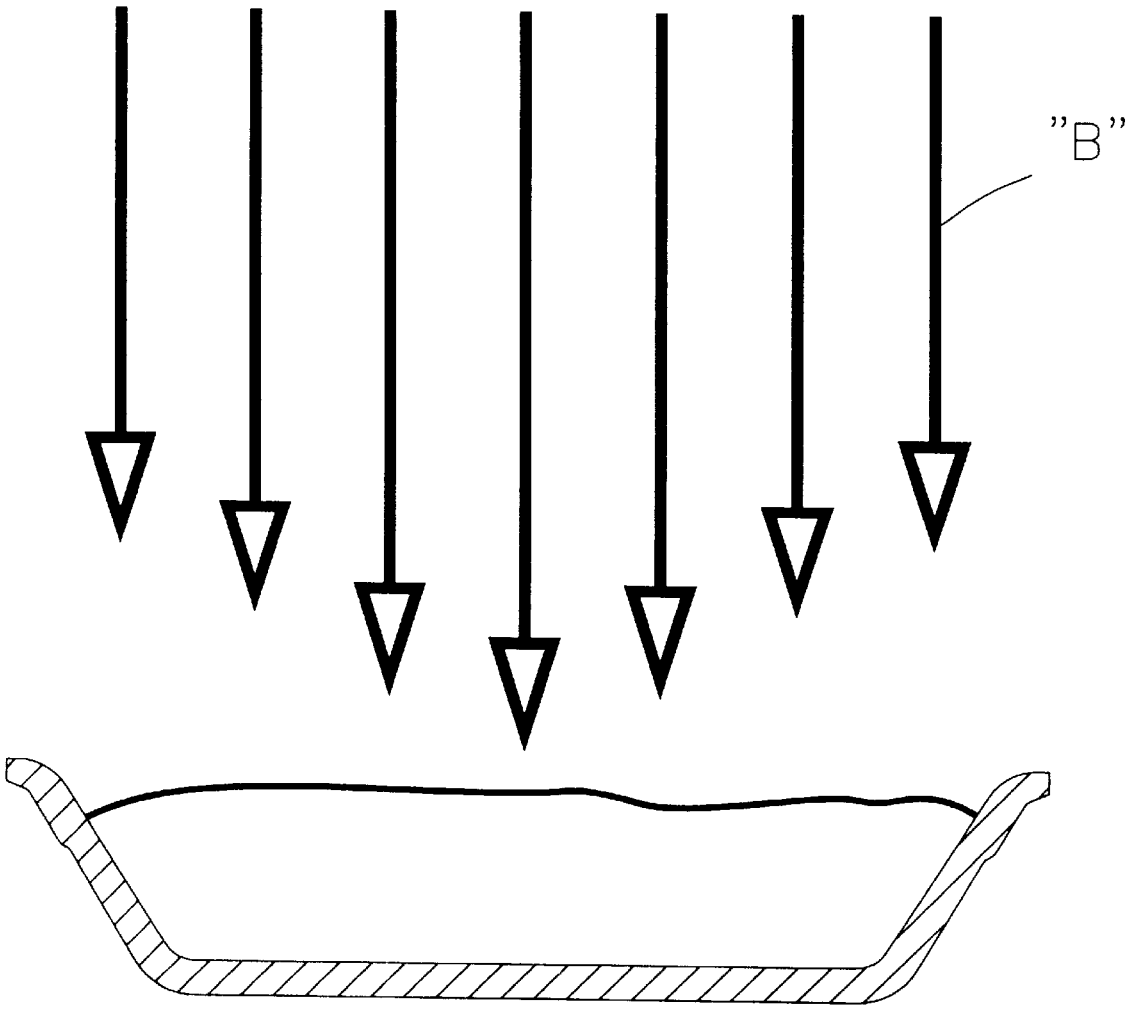
FIG. 3 is a cross-sectional schematic view of the process of exposing the meat product to an oxygen containing environment.

FIG. 2 shows the impermeable layer 18 being opened, for example, at a retail outlet close to the time when the meat is ready for retail sale. In FIG. 3, the meat product is exposed to a blowing stream of filtered air indicated by the arrows "B". By blowing highly filtered air directly on top of the exposed food product, it is possible to quickly bloom the meat to the red color. In this way, the retail outlet can, in rapid automated fashion, open up the package, bloom the meat, and process it for subsequent retail sale.

Figure 4:
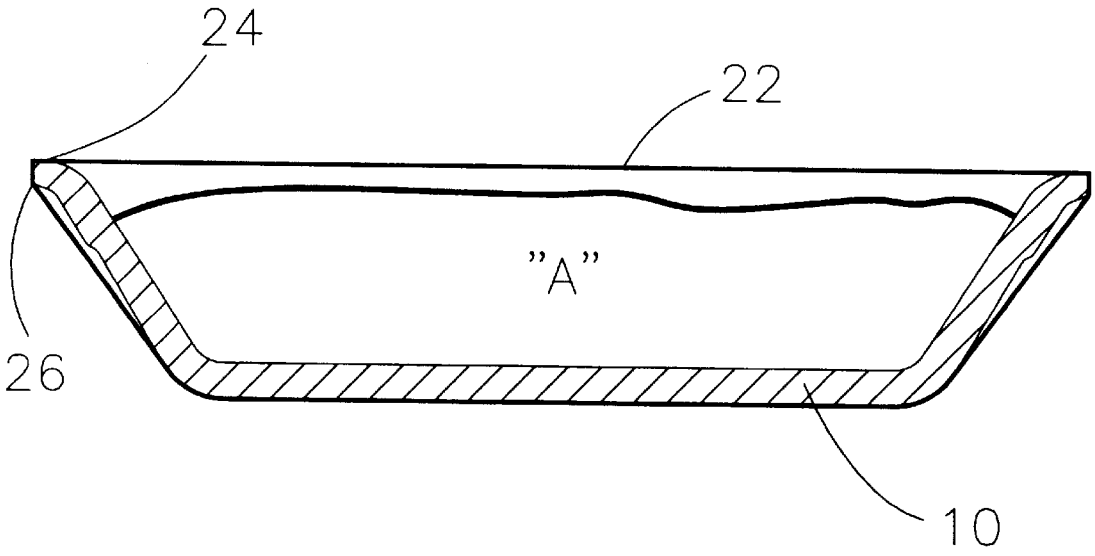
FIG. 4 is a cross-sectional view of the meat product having been re-covered at the retail outlet for sale to consumers.

In FIG. 4, the meat product "A" is shown repackaged inside a plastic overwrap 22. The plastic overwrap 22 may be provided by a conventional plastic overwrapping machine which overwraps the trays in automated fashion. Any conventional plastic overwrap material can be used. The tray 10 may include a pair of sealing edges 24 and 26 to prevent meat juices from escaping to the bottom of the overwrapped package.

Since the meat product is always maintained in the same tray 10, handling and cutting of the meat at the retail level is eliminated. Since the product can be maintained in a preservative gaseous environment until ready for use, the food product may be processed in a large scale operation for retail sale at a later date. Since the sealing flange 20 is relatively small compared to conventional packaging, it is easy to overwrap the tray 10.

Thus, it is apparent that there is provided in accordance with the invention a method that fully satisfies the aims and advantages set forth above. While the invention has been described in connection with specific embodiments thereof, it is evident that many alternatives, modifications, and variations will be apparent to those skilled in the art in light of the foregoing description. Accordingly, it is intended to embrace all such alternatives, modifications, and variations as fall within the true spirit and scope of the appended claims.

What is claimed is:

1. A method of packaging red meat products, comprising:

a. placing a meat product on a packaged tray;

b. creating a relatively low oxygen content environment around the meat product on the tray;

c. sealing a film to the tray to maintain the low oxygen content environment around the meat product;

d. peeling the film off of the tray when the meat product is ready for blooming;

e. exposing the meat product on the tray to an increased oxygen content atmosphere; and f. overwrapping the bloomed meat product on the tray with a sheet of plastic film secured to the bottom of the tray.

2. The method of claim 1, wherein the exposing step involves exposing the meat product to a flow of filtered air to expedite the blooming of the meat product.

3. The method of claim 1, wherein said re-covering step involves overwrapping said meat product and said tray.

* * * * *